US006791022B2

(12) United States Patent
Green

(10) Patent No.: US 6,791,022 B2
(45) Date of Patent: Sep. 14, 2004

(54) STRINGED MUSICAL INSTRUMENT

(76) Inventor: Philip Shepard Green, 820 Miranda Green, Palo Alto, CA (US) 94306

( * ) Notice: Subject to any disclaimer, the term of this patent is extended or adjusted under 35 U.S.C. 154(b) by 0 days.

(21) Appl. No.: 10/084,023

(22) Filed: Feb. 25, 2002

(65) Prior Publication Data

US 2003/0019349 A1 Jan. 30, 2003

Related U.S. Application Data

(60) Provisional application No. 60/276,215, filed on Mar. 15, 2001.

(51) Int. Cl.[7] ..... G10H 3/18

(52) U.S. Cl. ..... 84/731; 84/290

(58) Field of Search ..... 84/280, 291, 293, 84/267, 274, 275, 731, 270, 271, 283

(56) References Cited

U.S. PATENT DOCUMENTS

| | | | | |
|---|---|---|---|---|
| 3,910,151 A | * | 10/1975 | Copeland | 84/267 |
| 4,073,211 A | | 2/1978 | Jorgensen | |
| 4,111,093 A | | 9/1978 | Field et al. | |
| 4,254,683 A | | 3/1981 | Nulman | |
| 4,573,391 A | | 3/1986 | White | |

(List continued on next page.)

OTHER PUBLICATIONS

"Tacoma Papoose Travel Guitar" (no date; on www site).
"Outbound, the Travel Guitar"(no date; on a www site).
"Guitaround", ( on patent list also) (no date; on www site).
"Backpaper"(no date; on www site).
"Applause by Ovation AA10 Travel Guitar" and (Mfg?) Travel Guitar (no date; on www site).
"Traveler Guitar", (www site dated Jan. 21, 1999).
"Soloette", Wright Guitar Technology, (no date; on www site.).
"The Damsel A–6", (on patent list also) Chrysalis Guitars Brochure (no date).
"Yamaha Compact Silent Electic Cello–SVC 200" (www site download date Sep. 10, 2000) 2 pages.

*Primary Examiner*—Jeffrey Donels
(74) *Attorney, Agent, or Firm*—Beyer, Weaver & Thomas, LLP.

(57) ABSTRACT

A musical instrument adapted for string play comprises at least an elongated unitary neck and solid body, one or more support arms releasably or pivotally secured to the unitary neck and body, and one or more side panels releasably or pivotally secured to a support arm. A string tensioning system for tuning the instrument is secured to and spaced apart from the underside of the body portion and is operated in conjunction with a string-path reverser affixed to the proximal end of the body portion. The string-path reverser redirects the strings from the playing surface on the top of the body portion to the tensioning system underneath. Side panels are employed that approximate portions of the sides of the body of a conventional acoustic instrument, and connective means are employed that enable rapid assembly (or expansion) of the instrument for playing and rapid disassembly (or contraction). The components are readily arranged in a small carrying case for storage and transit. When assembled (or expanded) the subject instrument feels and responds like a conventional acoustic instrument. Guitar embodiments of the present invention are described. Acoustoelectric transduction is provided to convert the string vibrations to electrical signals, which are amplified. Electronic signal processing means are employed whereby the effects of the multi-resonant nature of the large hollow body of a conventional acoustic instrument are approximated. Input circuits are provided that enable sounds from other devices such as tape or digital recorders to be superposed with those of the instrument. Output circuits provide signals suitable for amplifier/loudspeaker and for headphone presentation. The latter facilitates "silent" practice. An electronic metronome and an electronic tuning aid are incorporated, and signal processing means are provided whereby the sound heard by a headphone wearing player will appear to emanate directly from the instrument.

31 Claims, 11 Drawing Sheets

U.S. PATENT DOCUMENTS 4,632,002 A * 12/1986 Clevinger ..... 84/731
4,646,613 A * 3/1987 Banchetti ..... 84/327
4,686,882 A 8/1987 Shaw
4,770,079 A 9/1988 Mastroianni
4,873,908 A 10/1989 Moore
5,040,447 A * 8/1991 Murata et al. ..... 84/612
5,058,479 A * 10/1991 Shaw ..... 84/291
5,654,514 A 8/1997 Tracey
5,929,362 A 7/1999 Oteyza
5,949,005 A 9/1999 Peterson
5,990,397 A * 11/1999 Taylor ..... 84/327
6,111,186 A * 8/2000 Krozack et al. ..... 84/736
6,191,348 B1 * 2/2001 Johnson ..... 84/485 R
6,255,565 B1 * 7/2001 Tamura ..... 84/275

* cited by examiner-

Fig. 16
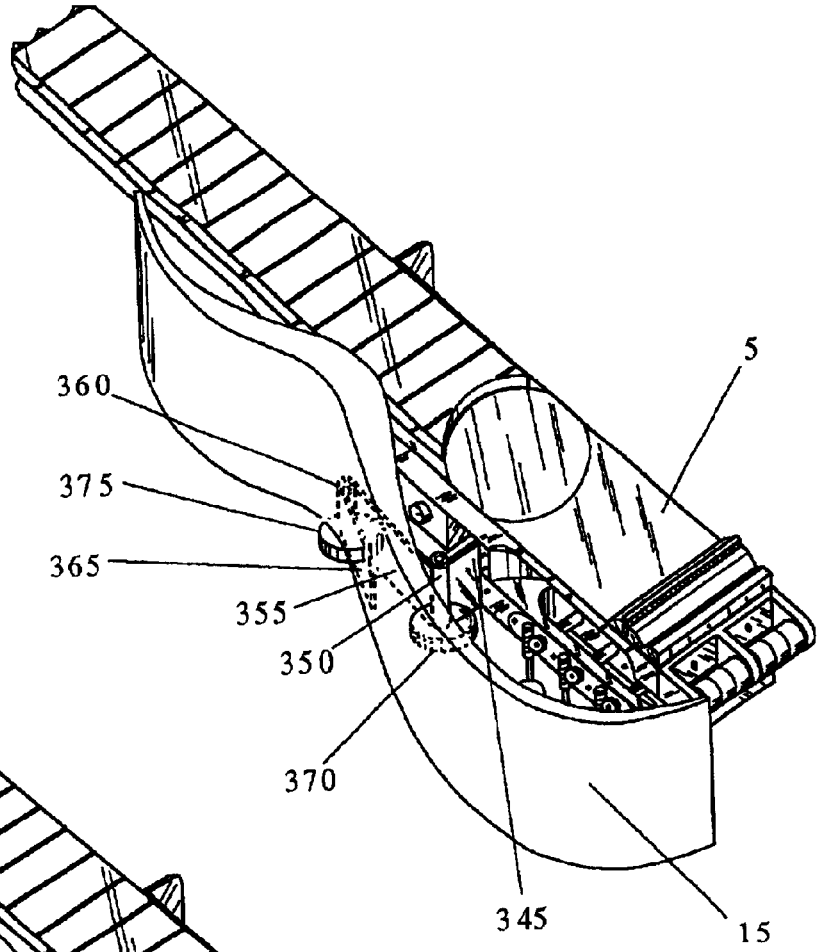
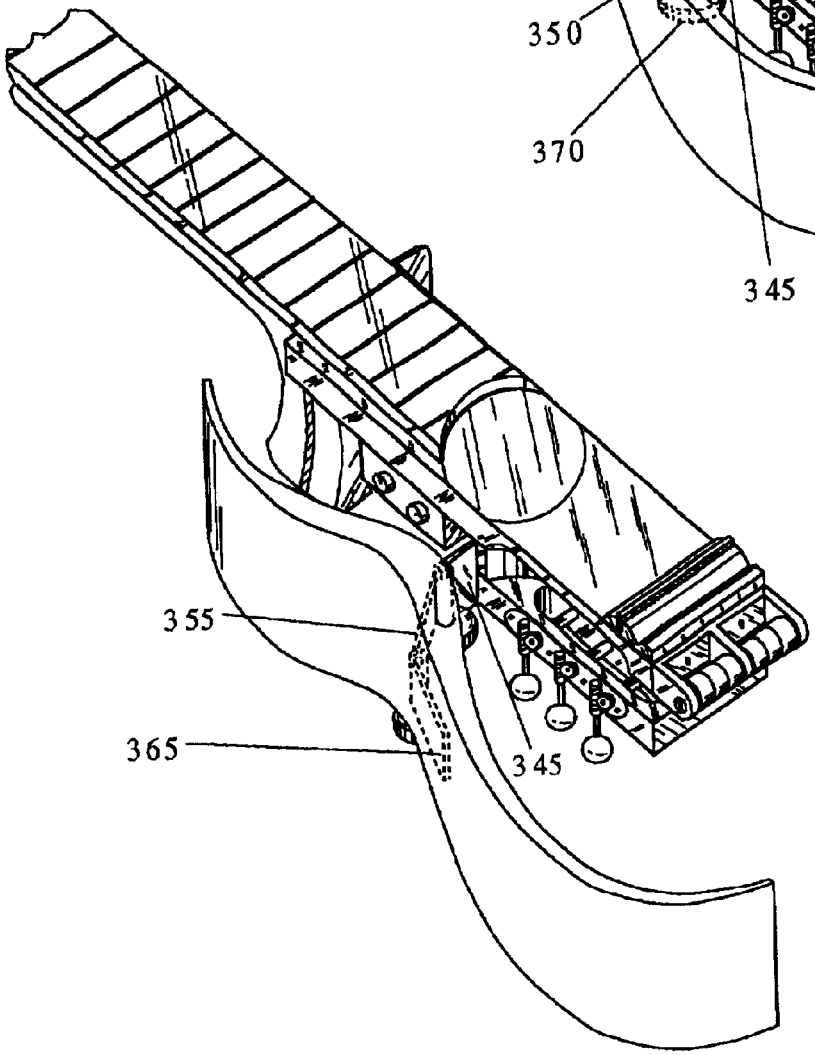
Fig. 17

STRINGED MUSICAL INSTRUMENT

CROSS REFERENCE TO RELATED APPLICATION AND DISCLOSURE

This application claims benefit of:

USPTO Provisional Application Serial No. 60/276,215, entitled "Stringed Musical Instrument with Detachable Components," filed Mar. 15, 2001; and is related to:

USPTO Disclosure Document Serial No. 479877, entitled "Travel and Practice Stringed Musical Instrument", filed Sep. 15, 2000, both of which are incorporated herein by reference in their entirety.

BACKGROUND OF THE INVENTION

Many stringed musical instruments, such as acoustic guitars, are large and cumbersome, and thus inconvenient to carry and stow during travel. Moreover, such instruments may not always be accepted as "carry-on" baggage on airliners. The alternative is consignment to the baggage compartment, which risks substantial damage to the instrument.

The present invention is directed to providing a stringed musical instrument especially suitable for travel, one that may be readily contracted into a smaller volume so that it can be conveniently carried and stowed during transit, and can then be quickly reconfigured for play. More particularly, the present invention is a contractible stringed instrument that incorporates novel systems and methods for emulating the look and feel of the body of a conventional acoustic instrument. In addition, the present invention is a stringed musical instrument that incorporates electronic means for amplifying the string vibrations and for emulating the resonant effects of the absent vibrating body of a conventional acoustic instrument. Provision is made for the amplified and enhanced electrical signals produced by this invention to be applied to an amplifier/loudspeaker combination or to headphones, the latter facilitating "silent" practice. Other novel features of the present invention are disclosed in detail below.

Although a guitar embodiment is particularly described herein, the present invention anticipates the application of the disclosed apparatus and methods to other stringed instruments as well.

Prior attempts to provide a compact guitar for travel have taken several forms. Numerous short-necked and small-bodied guitars have been devised. One example of such an instrument is the "Backpacker" guitar manufactured by C. F. Martin and Co. of Nazareth, Pa. However, these compromises are not acceptable to most players of conventional acoustic guitars. Such players generally prefer to perform and to practice with an instrument of substantially standard neck length and body size and shape. The size and shape of the guitar is especially critical to the seated player; the body of the guitar rests on their lap and against their chest while their right arm rests on the top of the guitar body. Each player will have a preferred variation of this position. Instruments that are too small or of unconventional shape cannot accommodate these positions. They are difficult to play and promote bad playing posture. Moreover, the small resonant bodies of these instruments paradoxically produce too little sound for performance purposes and too much sound for "silent" (i.e., quiet) practice. The latter is of importance when, for example, practicing in hotel rooms at night.

Prior-art guitars have also been made wherein the hollow body is entirely eliminated, being replaced by a narrow solid-wood body to which the bridge is attached. Deployable extension arms attached to the instrument body are positioned to contact the player's body at selected points. One example of such an instrument is the "Traveler Guitar" made by a company of the same name in Redlands, Calif. This instrument enables "silent" practice using either a stethoscope or electronic detection and amplification for presentation on earphones. However, it has neither the look nor the feel nor the sound quality of a hollow-bodied acoustic guitar. To approximate the shape of a conventional acoustic guitar, the "Soloette" travel/practice guitar manufactured by Wright Guitar Technology of Eugene, Oreg., employs three curved metal rods that are plugged into its solid body. These rods form a thin, linear outline of a conventional guitar body. However, a linear outline is not adequate to provide the guitarist with the "feel" of a real, three-dimensional guitar body. Moreover, this instrument lacks many of the other features of the present invention. The Compact Silent Electric Cello-SVC 200, designed by Yamaha Corp. of America and Japan, employs a solid central core with fixed and retractable elements attached, the latter contact with the player's body.

The present invention, is directed, in part, to overcoming the deficiencies in the prior art, by providing the player with an instrument that can be rapidly assembled (or expanded) for use and disassembled (or contracted) for travel, whereupon it can be transported within a case much smaller than that required for a corresponding conventional acoustic instrument. Moreover, the present invention provides for acoustic filter elements and electronic signal processing circuits by which the sounds produced by the instrument approximates those of a conventional acoustic instrument, and output means by which the instrument may be played through an amplifier/loudspeaker or through headphones, for "silent" practice.

The present invention also provides for the inclusion of an electronic tuning aid to facilitates adjustment of the instrument's strings to the desired pitch, an electronic metronome, input means by which prerecorded music may be heard in conjunction with the instrument's sounds, and electronic filtering means to supply, via headphones, differently conditioned signal to the player's left and right ears so as to create the auditory impression that the sound is emanating directly from the instrument rather than from the headphones.

To provide visual assistance to the player for the proper position of his right hand, the present invention incorporates a sound-hole-likeness affixed to the top face of the body section below the fingerboard. This further contributes to the instrument's similarity in appearance to a conventional acoustic instrument. Moreover, a word or symbol may by applied to it for product labeling.

SUMMARY OF THE INVENTION

In accordance with one aspect of the present invention, a stringed musical instrument such as a guitar comprises: (1) a central unit comprising at least an elongated unitary neck and body, and such components as: a fingerboard; strings; and a string tensioning system, (2) one or more side panels that simulate segments of the perimeter of the resonating chamber of a conventional acoustic instrument, and (3) one or more coupling members, or support arms, by which the side panels are coupled to the central unit.

In accordance with another aspect of the present invention, a string tension system comprising adjustable tuning machines or pegs mounted on a tuning board, which board is affixed to the body section and located below it, i.e., on the side of the body section opposite the playing surface (the top). A plurality of rollers located at the proximal end of the body section (the end opposite that to which the neck adjoins), said rollers providing a low-friction means for partial reversal of the string paths, enabling the strings to be attached to the machines or tuning pegs.

In accordance with another aspect of the present invention, a bridge, located on the upper surface of the body section near its proximal end, receives a saddle and an electro-acoustic pickup and incorporates a string guide that provides spaced-apart holes or slots that receive the strings and hold them in the desired separate positions. Additionally, a coupling element, such as a strip of compliant material, interposed between the saddle and the pickup or between the pickup and the bridge to improve acoustic transmission and alter the spectral characteristics of the acoustic signal.

In accordance with another aspect of the present invention, a tie-block affixed near the distal end of the neck provides spaced-apart holes to receive the strings and secure them to the neck in the desired positions. A spacer, which may be incorporated with the tieblock, separates the tieblock from the nut (a notched string guide that, in conjunction with the saddle, determines the active string length) and secures the nut against the distal end of the fingerboard.

In accordance with another aspect of the present invention, side panels, approximately conforming to portions of the sides of the body of a conventional acoustic instrument, are releasable coupled to a support arm, which arm is releasably coupled to the central unit.

In another embodiment of the present invention, a side-support system comprises one or more arms pivotally attached to the central unit, and releasably coupled to the side panels. Stops are provided on the central unit to limit the degree of rotation of the arms to their deployed positions, and securing means are provided to releasably secure the arms against the stops. When released, the panels may be removed and the arms retracted against or beneath the body for compact storage, In accordance with another aspect of the present invention, the securing means described above comprises a connecting member releasably coupled between the side panels at their lower ends, which also serves to provide closure at the bottom portion of the perimeter of the simulated acoustic-instrument body.

In accordance with another aspect of the present invention, one or more support arms are pivotally coupled to the central unit and pivotal coupled at its distal end to a side panel. Securing means are provided to lock each pivot at selected rotational positions, whereby they may be secured either in their deployed positions or in their storage positions. In the latter case, the side panels are drawn in against the central unit.

In accordance with a guitar embodiment of the present invention a heel is provided at the juncture of the neck and the body sections, to which is affixed a short portion of a side panel simulating the corresponding portion of the side of a conventional acoustic guitar where it abuts the neck.

In accordance with another aspect of the present invention, the several detachable components of the musical instrument are juxtaposed in a container for secure and convenient transportation.

In accordance with another aspect of the present invention, electronic circuits are provided by which electrical signals from the pick-up, corresponding to vibrations of the strings, are amplified for presentation through either headphones or an amplifier/loudspeaker system. Additionally these electronic circuits modify the spectral and temporal characteristics of the electrical signals to approximate the resonance effects provided by the resonating hollow body of a conventional instrument.

In accordance with another aspect of the present invention, electronic circuits for either tone generation or pitch detection are provided to facilitate tuning the instrument and circuits are provided for the generation of metronome sounds, which are combined electronically with the instrument's signals, allowing the player to hear both at once. Additionally, a line-input jack and circuit are provided to enable the player to hear prerecorded music while practicing and learning.

In accordance with another aspect of the present invention, filter circuits are provided that, when utilized in conjunction with stereo headphones, alter the characteristics of the sound heard by each ear in such a way as to give the player the perception that the sound is radiating from the position of instrument rather than from the headphones.

BRIEF DESCRIPTION OF THE DRAWINGS

FIG. 16 is a partial perspective view of a guitar wherein the side panel is coupled to the central unit by means of a multiply pivoted support arm that permits the side panel to be retracted to a position close to the central unit for storage. The side panel is shown in the retracted position.

FIG. 17 is a view of the guitar of FIG. 16 with the side panel shown in the deployed position.

DESCRIPTION OF THE INVENTION

In the following description, various aspects of the present invention are disclosed with reference to their application to a guitar. However, it will be obvious that many aspects of the invention apply to other types of stringed instruments as well. Such applications lie within the scope of this invention.

Figure 1:
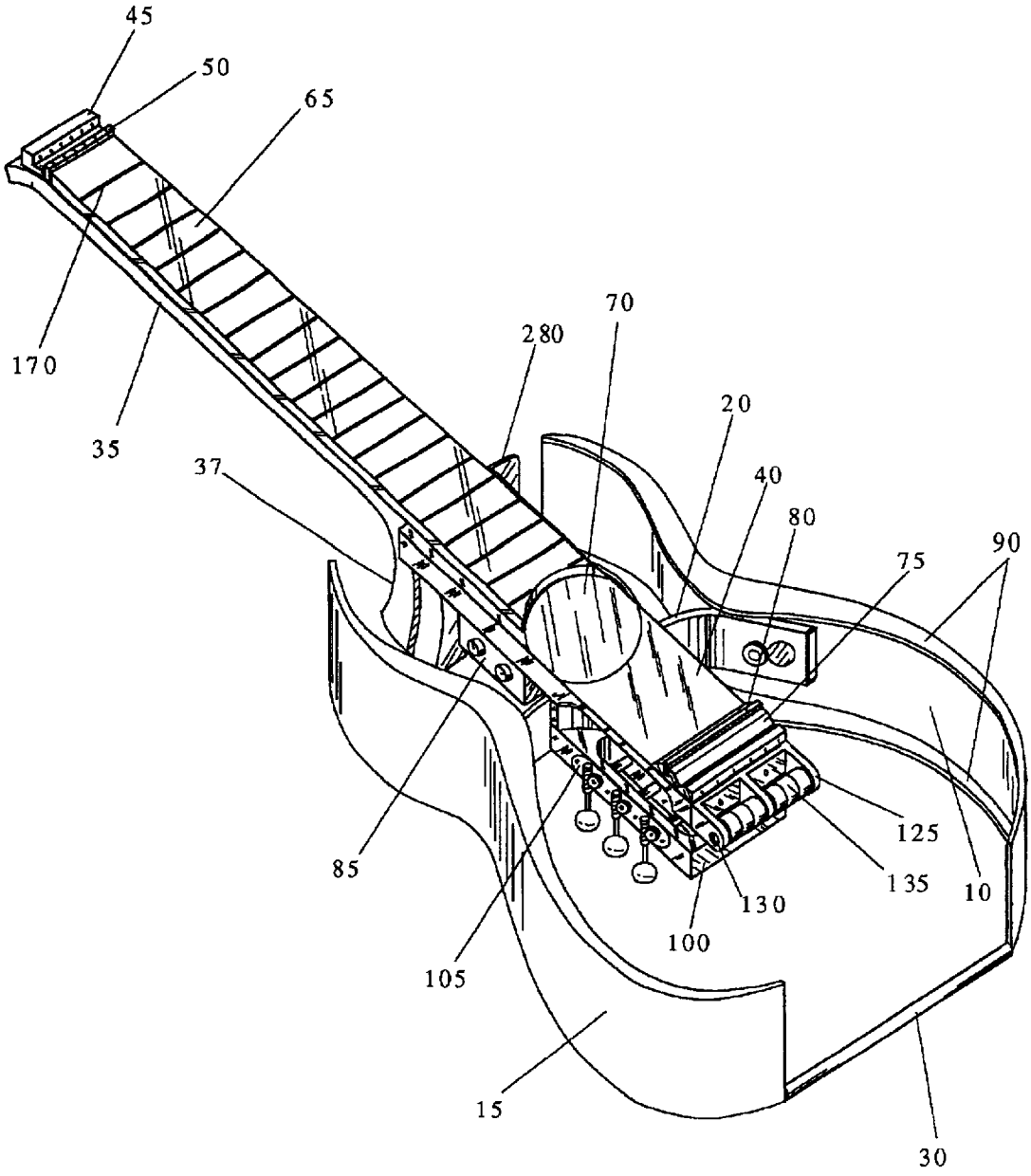
FIG. 1 is a perspective drawing of a guitar, comprising (1) a central unit composed of a neck-and-heel portion rigidly coupled to a body portion, strings, a tieblock for anchoring the strings at the distal end of the neck, a nut, a string tensioning system comprising tuning machines mounted on a tuning-machine block, which is secured to the body at a location below and spaced apart from the body at its proximal end, a bridge and saddle, a string-path-reverser secured to the proximal end of the body portion by which the strings are redirected to the tuning system, a fretted fingerboard, a circular applique representing the sound hole of an acoustic guitar, a bridge assembly, and an electronics unit; (2) two detachable side panels; (3) a detachable side-panel support arm; and (4) a detachable bottom brace.
Figure 2:
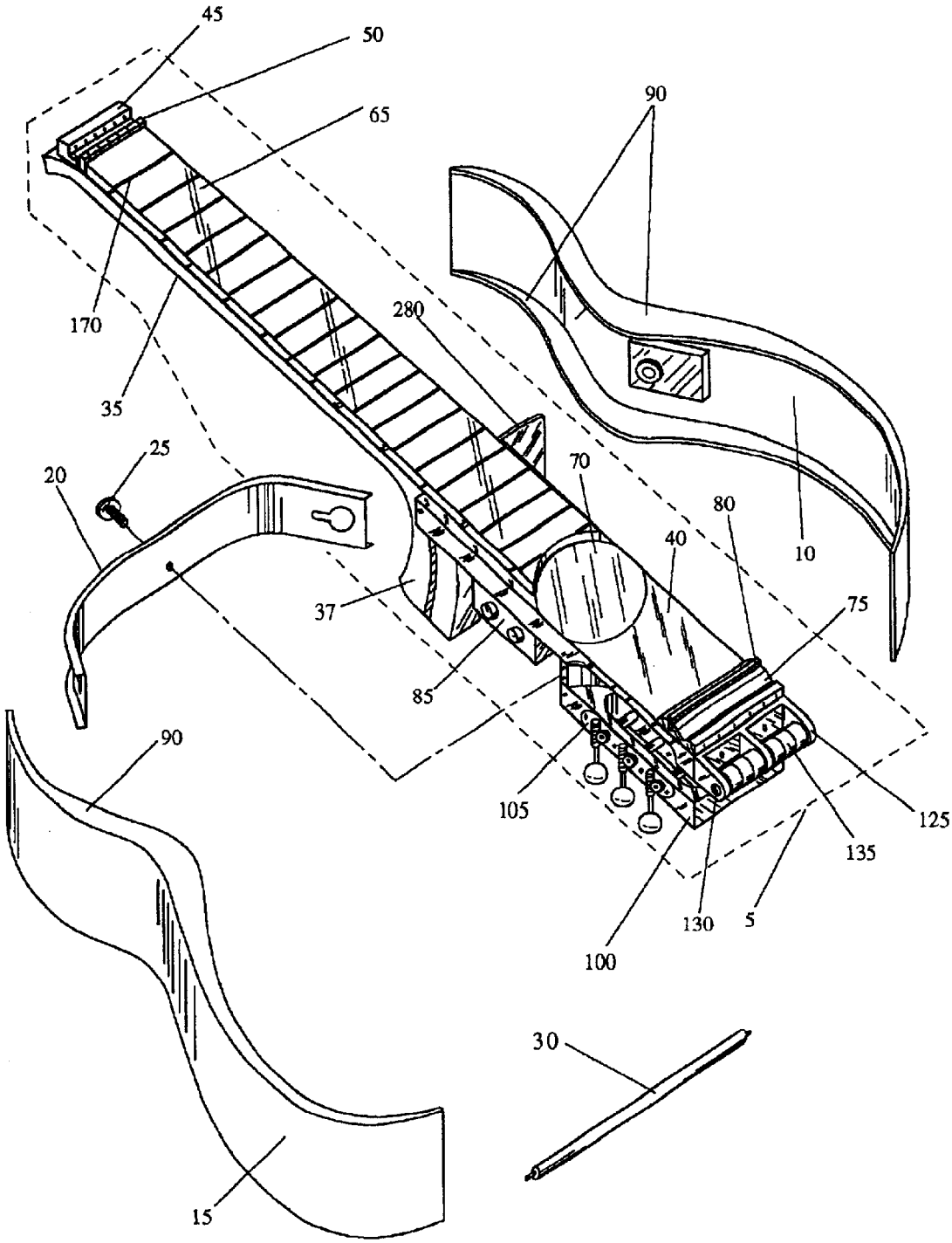
FIG. 2 is a perspective view of the guitar of FIG. 1 with the side panels and the side-panel support arm detached.

FIG. 1 is a perspective drawing of and FIG. 2 is a disassembled view of a guitar, comprising central unit 5, first and second detachable side panels, respectively 10 and 15, detachable side-panel support arm 20, support-arm thumbscrew 25 and detachable bottom brace 30. The central unit comprises neck 35 and heel 37 rigidly attached to body portion 40, guitar strings (for clarity, not shown in these views), tieblock 45 for anchoring the strings at the distal (upper) end of the neck, notched nut 50, string-tensioning system 55 secured to the body portion and spaced apart from and below the body portion near its proximal end and itself comprising tuning-machine block 100 and tuning machines 105 (see FIG. 3), string-path reverser 60 secured to the proximal (lower) end of the body portion, by which the strings are redirected to the string tensioning system, fretted fingerboard 65 with frets 170, circular applique 70, representing the sound hole of a conventional acoustic guitar, bridge 75 and saddle 80, and electronics unit 85. These and other components of central unit 5 are described in detail with respect to subsequent figures.

Side panels 10 and 15 approximate, in their size and shape, opposing segments of the side of a conventional acoustic guitar. The segments are selected to provide appropriate contact with the player's body for the various postures that are likely to be assumed during playing. The side panels may be made of a variety of materials, including wood and metal. Vacuum-formed, injection-molded, and structural-foam plastics, using materials such as acrylic, are particularly well suited to this application. Curved edges 90 are formed on the side panels to stiffen them and to suggest the presence of the top and bottom of a guitar body.

Figure 3:
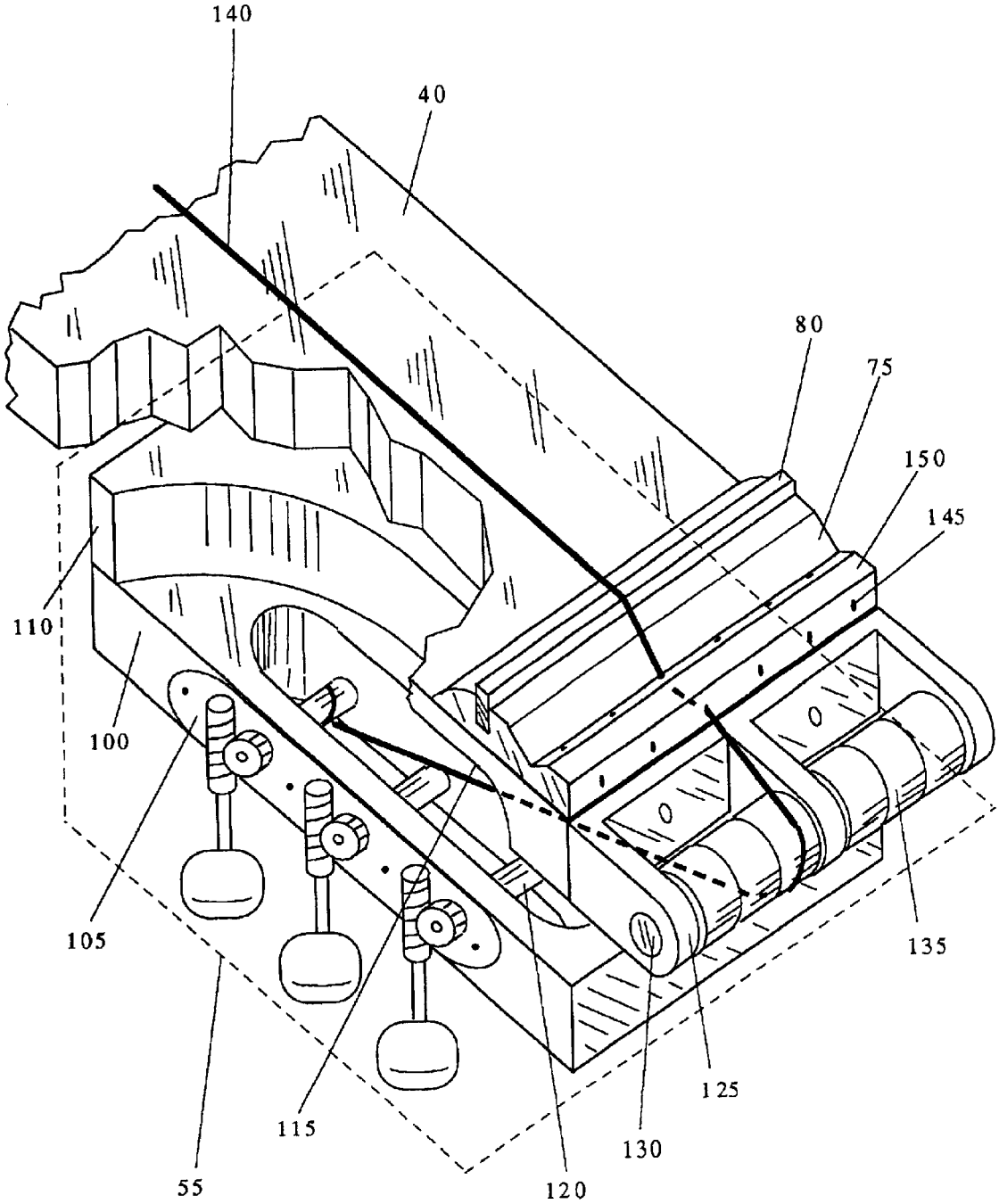
FIG. 3 is a partially cut-away perspective drawing of the proximal portion of the central unit of the guitar of FIG. 1, showing the bridge and saddle, the string-path reverser and the string tensioning system, comprising opposing tuning machines (one of two is shown) mounted on a slotted tuning-machine block that is rigidly attached to the body portion by a spacer. For clarity, only one of six strings is illustrated.
Figure 4:
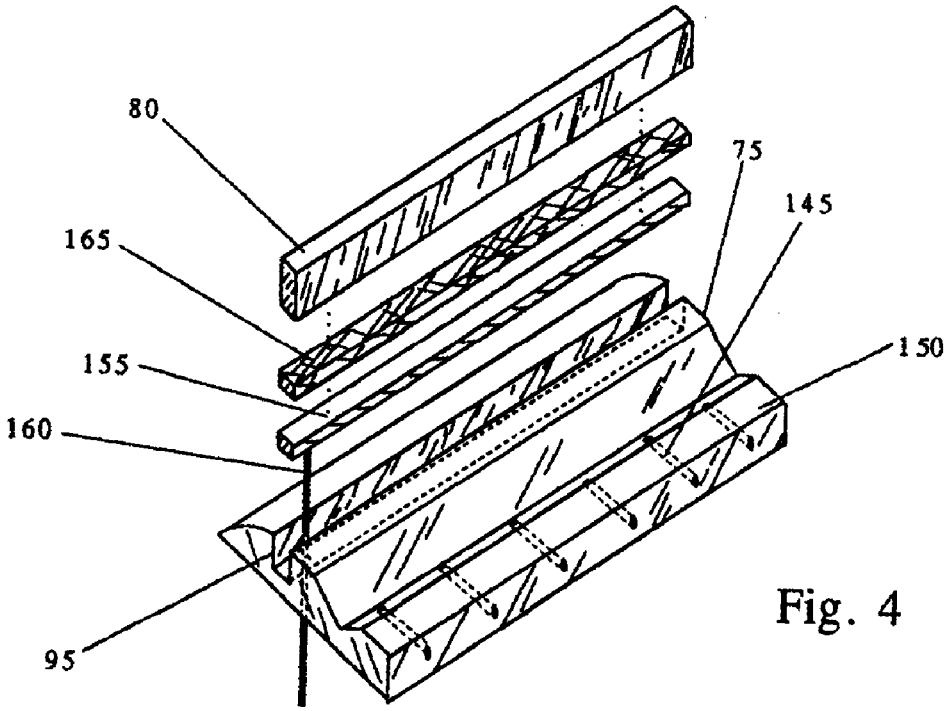
FIG. 4 is an exploded perspective view of the bridge assembly of the FIG.-1 guitar, including the saddle, a coupling element in the form of a strip of compliant material, a piezoelectric pickup, and string guides.

Attention is now directed to FIGS. 3 and 4, which illustrate respectively the proximal portion of the central unit of the guitar of FIG. 1 and an exploded view of the bridge and its associated components. As illustrated in FIG. 3, string tensioning system 55 comprises machine block 100, slotted and drilled to receive a pair of opposed tuning machines 105 (one shown). Block 100 is spaced apart from and secured to body portion 40 of central unit 5 by spacer 110. Locating the tuning machines in this position rather than in line with the neck and body portions makes the disassembled instrument substantially shorter than a conventional guitar, and thus more easily transported. It is apparent that, as with conventional guitars, tuning pegs or individual tuning machines for each string may be substituted for the three-string machine illustrated here. A relieved segment 115 of the lower side of the body portion (see also FIG. 6) provides better access to the tuning-machine rollers 120, facilitating attachment of the strings.

The string-reversal system, affixed to the proximal end of the body, comprises a cage 125, an axle 130 received within the cage, and six low-friction pulleys 135 that serve to redirect the strings toward the tuning-machine rollers 120. For clarity, only one string 140 of six is shown. The strings pass through spaced-apart holes 145 in string-guide 150 of the bridge 75, which provides for correct string position. Although slots in the top of the string-guide portion may be substituted for the guide holes, guide holes have the further advantage of securing the string in position while their ends are being attached to the tuning-machine rollers.

FIG. 4 shows in more detail the bridge 75 and the components received in the bridge slot 155. The bridge, which may be made of wood or other suitable material, is affixed to the top of the body near its proximal end, at a position determined by the tuning requirements of the instrument. Saddle 80, which is made of bone or a hard composite material, is received in bridge slot 95. In this embodiment, a piezoelectric under-saddle pick-up 155, such as the Model PU 0860-000 Piezo Guitar Pickup sold by AllParts of Katy Tex., is used. However, alternative sensors of other designs and placement locations may be substituted within the scope of this invention. The electrical lead wire 160 projects down through the bridge and guitar body and is dressed back to the electronics unit 85 (not shown in this figure.) In the illustrated embodiment, a strip of compliant material 165 is inserted between the saddle and the pickup. The compliant material improves acoustic coupling between the saddle and the pickup and, to the degree to which it is sound-absorbing, removes a portion of the string's vibrational energy before it is transmitted to the pickup, there by damping the vibration—i.e., shortening the "ring-down" time. This absorption emulates the loss of energy that is encountered in a conventional hollow-body acoustic guitar, which arises from radiation of sound energy into the surrounding air and from vibrational energy losses in the body material. Alternatively or additionally, compliant material with preferred acoustic properties can be interposed between the pickup and the bottom of the bridge slot.

Figure 5:
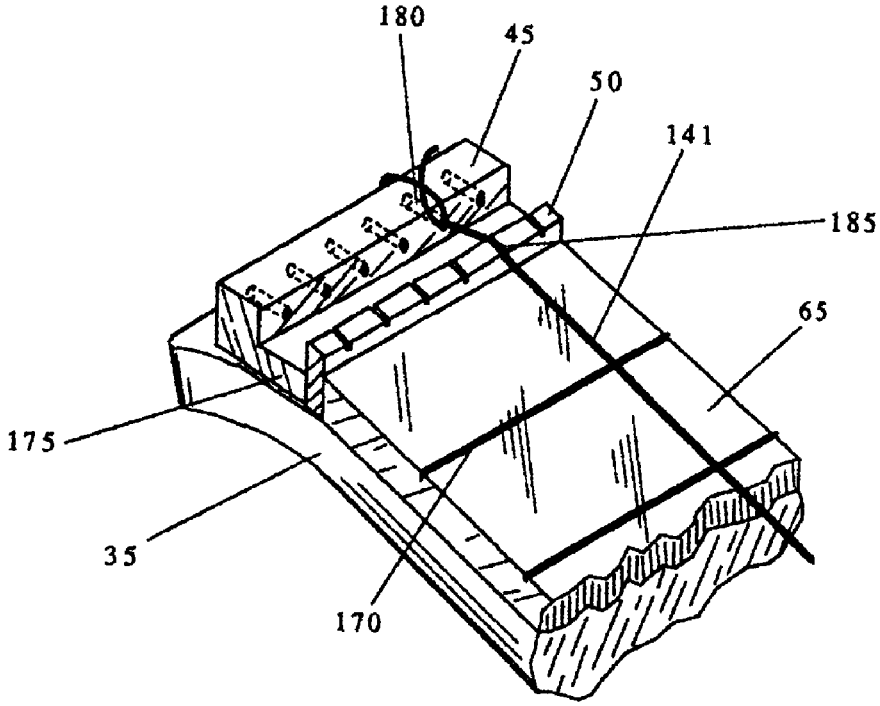
FIG. 5 shows a perspective view of the distal portion of the neck of the guitar of FIG. 1, including a portion of the fretted fingerboard, the nut, the tieblock, and one of six strings.

FIG. 5 illustrates the distal end of neck 35, whereon tieblock 45 is attached. String 140 is terminated at tieblock 45 by passing it through a corresponding hole 180 in the tieblock and forming a twist knot, as is commonly practiced on the bridge tieblock of a classical guitar. Alternatively, pegs or other common guitar-string anchoring methods may be employed.

String 140 is dressed through its corresponding notch 185 on nut 50, wherein it is retained owing to string tension. To allow finger access for knot tying in the illustrated embodiment, tieblock 45 is spaced apart from nut 50 by proximal extension 175 of the base of the tieblock. Nut 50 is snugly received within the gap between extension 175 and the end of fingerboard 65.

Figure 6:
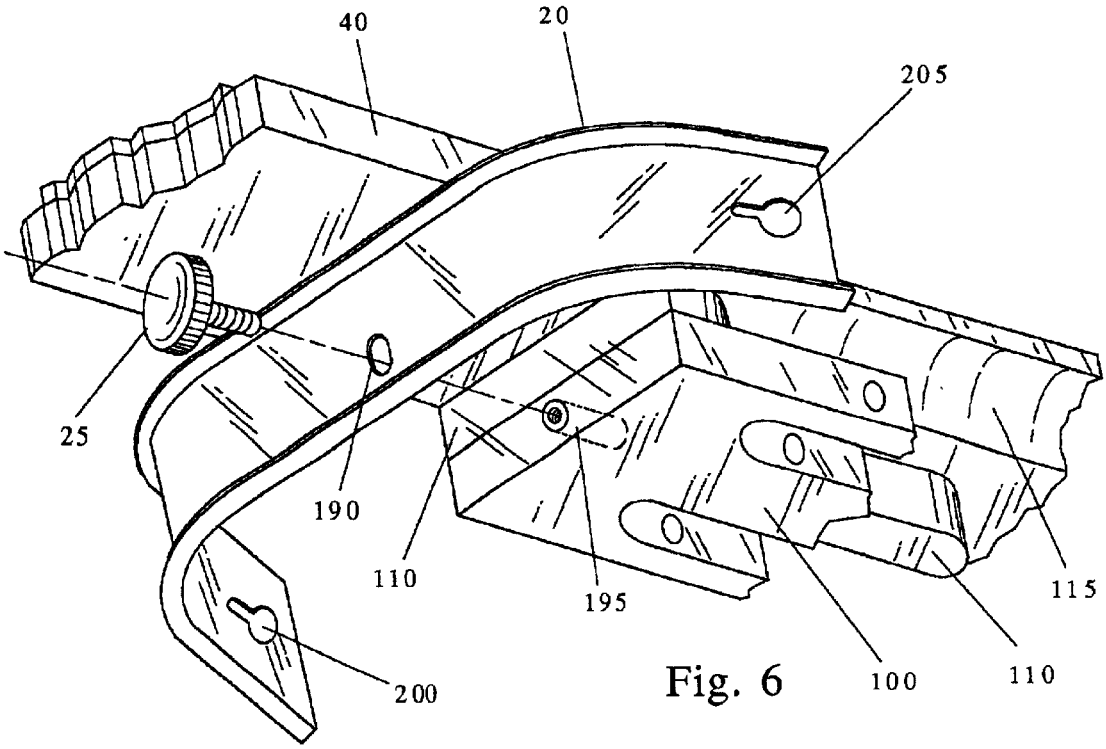
FIG. 6 is a perspective view of the underside of the body portion with attached spacer and tuning-machine block, showing the manner in which the side-panel support arm is releasably attached to the tuning-machine block.
Figure 7:
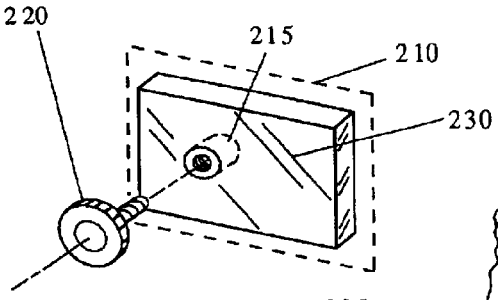
FIG. 7 is a perspective drawing of the receiver affixed to each side panel, by which the arm and the side panel are coupled. The receiver comprises a rectangular block with a captive nut into which a thumbscrew is threaded.
Figure 8:
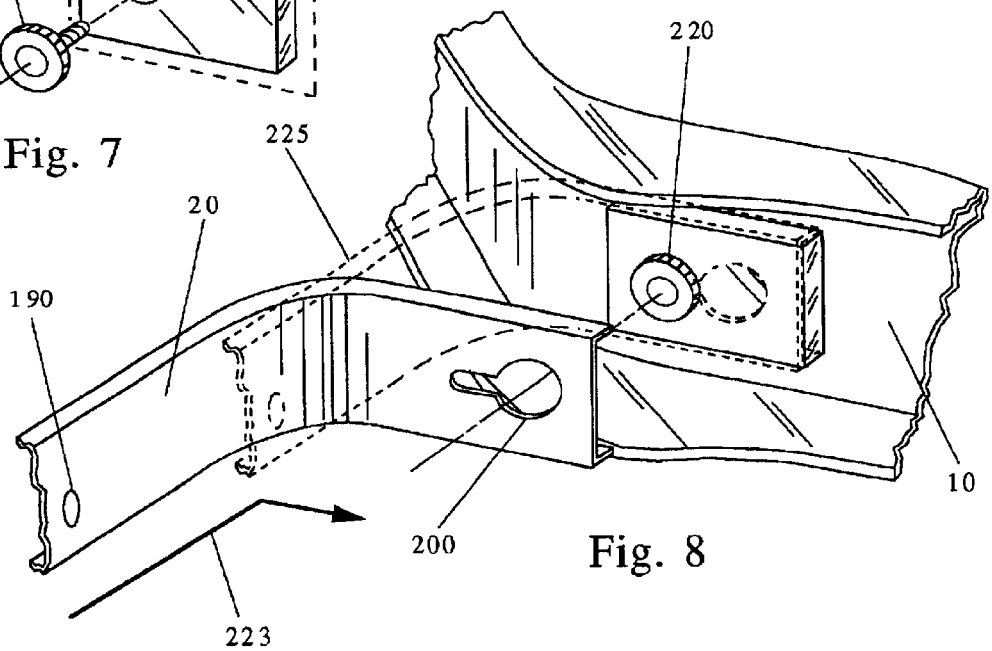
FIG. 8 is a perspective view of a portion of one side panel, and a portion of the side-panel support arm, illustrating the manner in which the side panel is attached to the arm.

The methods by which side-panel support arm 20 of the guitar embodiment of FIGS. 1 and 2 is releasably secured to central unit 5 and by which side panels 10 and 15 are releasably secured to support arm 20 are illustrated in FIGS. 6, 7 and 8. Referring to FIG. 6, the support arm comprises a shallow channel, bent into nearly a "U'-shape, but with its ends flared outward rather than parallel. The exact shape of support arm 20 is selected to position the side panels properly with respect to the central unit. The support arm must be substantially rigid. It may be formed of a metal, such as aluminum, in which case, reinforcing gussets may be desirable to achieve the required degree of rigidity while minimizing weight. Support arms may also be cast in plastic. The threaded portion of thumbscrew 25 is inserted through elongated hole 190 in the central region of support arm 20. The thumbscrew may be removable or may be captive within hole 190. Support arm 20 is then secured to central unit 5 by screwing thumbscrew 25 into threaded insert 195, which is captive within the slotted block 100 and accessible on its distal surface. The distal surfaces of tuning-machine block 50 and spacer 110 are coplanar, forming an extended surface against which support arm 20 rests. The support arm is held against the underside of body portion 40 while thumbscrew 25 is being tightened. This further ensure that arm 20 cannot rotate about the axis of thumbscrew 25.

As illustrated in FIGS. 6, 7, and 8, keyholes-shaped apertures 200 and 205 are provided near the ends of support arm 20. These are employed for attachment of arm 20 to side panels 10 and 15. As shown in FIG. 7, receiver 210 comprises a substantially rectangular block of rigid material bonded to the inner surface of side panel 10. A captive nut 215 within the receiver is accessible from the receiver's exposed face 230. Thumbscrew 220 is threaded partway into nut 215.

FIG. 8 illustrate the method by which side panel 10 is releasably secured to support arm 20 (side panel 15 is similarly secured on the opposite side of the support arm.) The circular portion of keyhole-shaped aperture 205 is larger in diameter than the head of thumbscrew 220; thus, the arm can be impressed upon the receiver without removing the thumbscrew from the receiver. The channel width of the support arm is such that the end portion of the arm fits snuggly over receiver 210. To attach side panel 10 to the support arm, the knob portion of the loosened thumbscrew 220 is first inserted through the large, circular portion of the arm's aperture. The arm is then moved according to arrow 223, first toward the side panel and then, after engaging the screw portion of thumbscrew 220, forward to position 225, wherein said screw portion lies at the end of the slotted portion of the keyhole. Thumbscrew 220 is then tightened to secure the side panel. The sides of support arm may be slightly flared so that the fit with the corresponding sides of the side-panel receiver block 210 will become tighter as the arm is drawn down against said receiver block by the thumbscrew.

Figure 9:
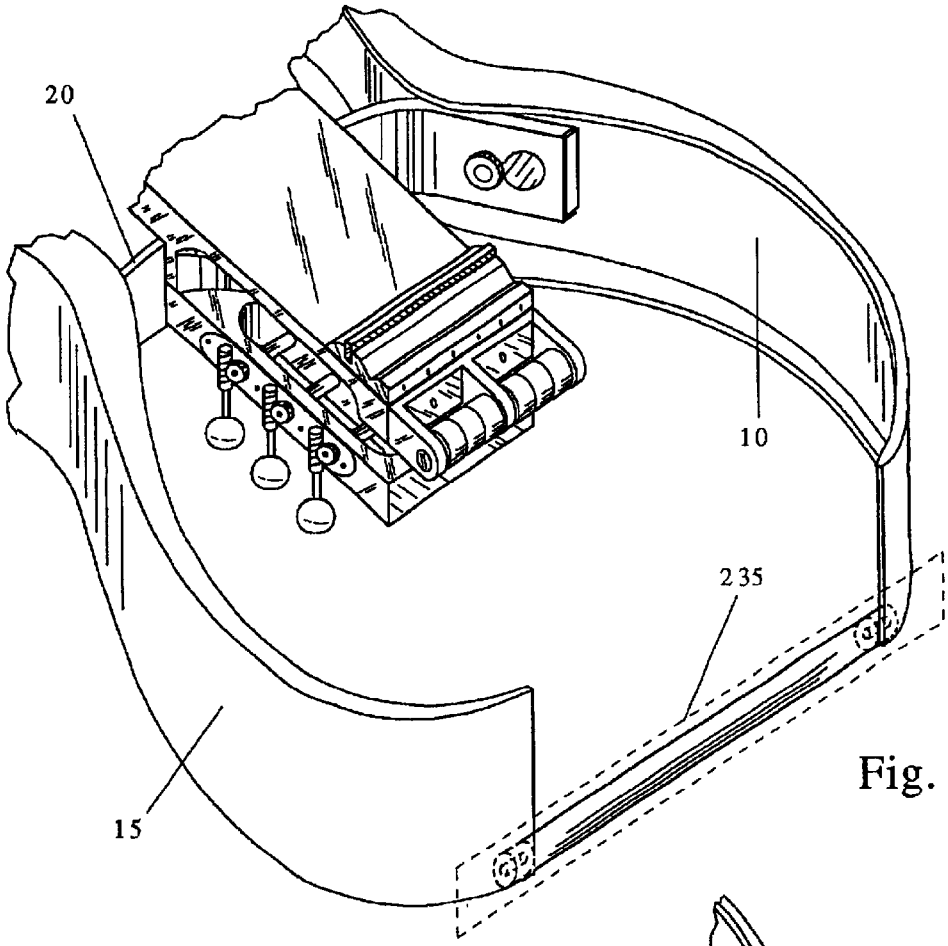
FIG. 9 is a perspective drawing of the lower portion of the assembled guitar of FIG. 1, showing a cylindrical bottom brace installed between the side panels.

As illustrated in FIG. 9, bottom-brace assembly 235 couples side panels 10 and 15 at their bottom ends, providing additional stability to the assembled guitar and completing the guitar perimeter at the bottom, which is of particular benefit to, for example, guitarists accustomed to resting the base of a guitar against their leg.

Figure 10:
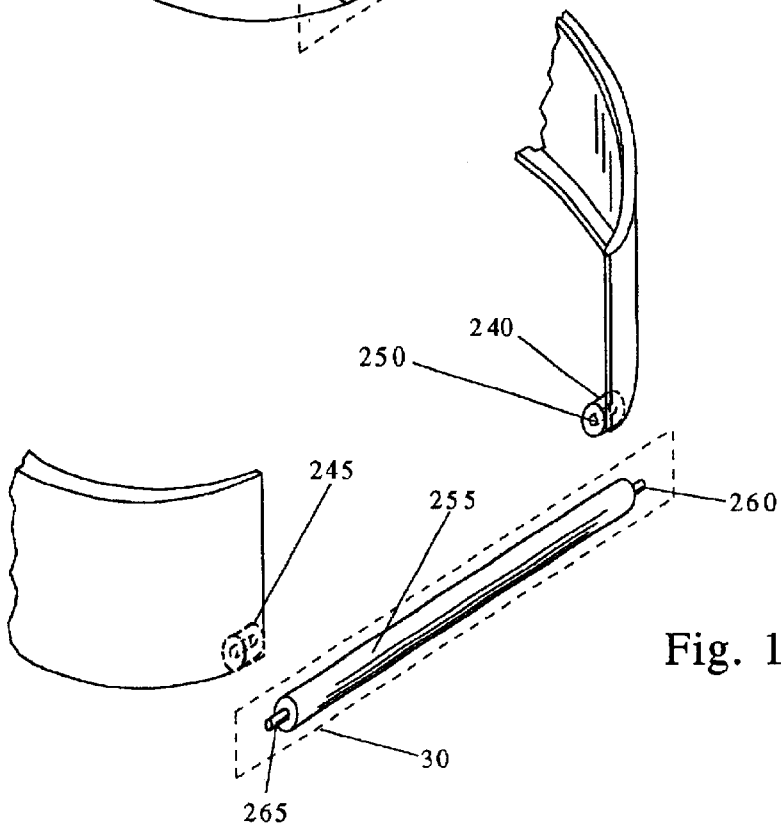
FIG. 10 is a perspective view of the lower portion of the structures shown in FIG. 9 but with the bottom brace removed and displaced, illustrating the method of coupling. The bottom brace comprises, in part, a cylindrical rod spanning at least the distance between the tips of the side panels. Secured in each end of this rod is a metal post of smaller diameter. These are inserted into mating receivers affixed to the ends of each side panel.

FIG. 10 illustrates the manner in which bottom-brace assembly 235 functions. Side panels 10 and 15 of the embodiment of FIG. 9 are provided with bottom-brace receivers 240 and 245 respectively, the receivers comprising ferrules, each with a central bore 250. Each ferrule is joined to the inner surface of its corresponding side panel at the latter's lower end. If the side panels are, say, vacuum-formed of acrylic, than the receivers may be short segments of bored acrylic rod, bonded in place. If the side panels are castings, the ferrule may be cast as an integral part of the side panel. A thin-walled metal tube (not shown) may be bonded within the ferrule bore, for added strength. When side panels 10 and 15 are mounted on support arm 20, as illustrated in FIG. 8, receivers 240 and 245 form an opposing pair.

Bottom brace 30 of bottom-brace assembly 235 comprises bottom-brace rod 257, made, for example, of plastic or wood, with smaller-diameter metal posts, 260 and 265, projecting from each end. Said posts are sized to be received within bores 250.

To assemble the instrument, one may first attach support arm 20 to the central core 40, then attach one side panel to the support arm and fix it in place by tightening its thumbscrew. Then, the bottom brace would be inserted into the receiver at the bottom of the attached side panel. Finally, the second side panel would be coupled loosely to the support arm, its bottom-brace receiver coupled to the opposite end of the bottom brace, and then its thumbscrew tightened. The length of the bottom-brace rod is slightly larger than the space between the receivers when the instrument is assembled. The bottom brace is thus trapped by compression between the side panels. The rigidity of the entire assembly is thereby made greater.

Figure 11:
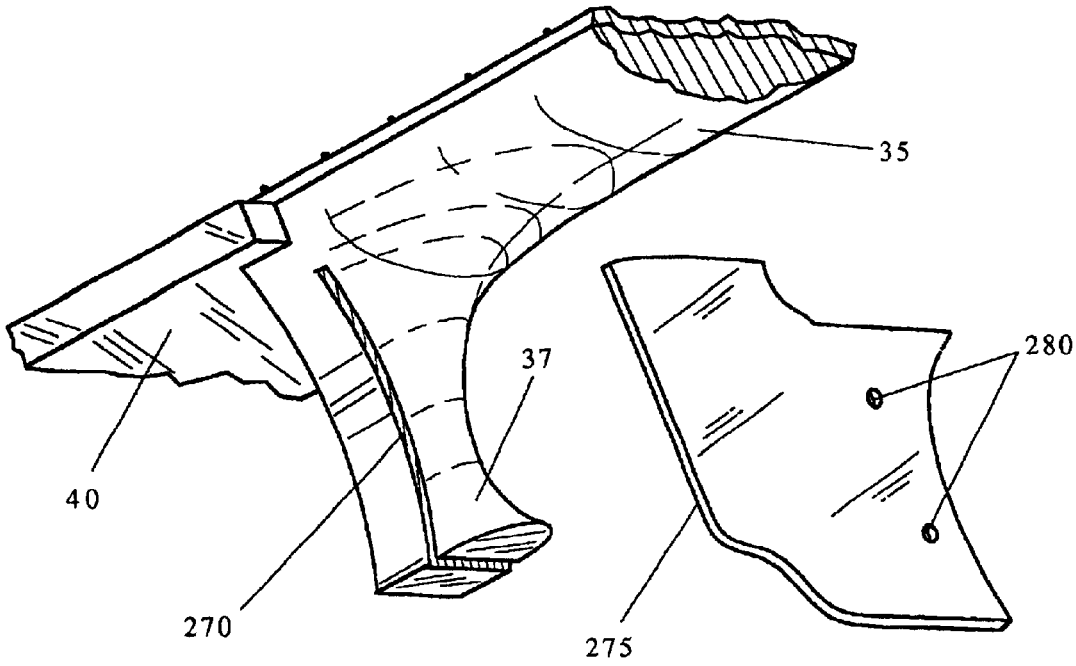
FIG. 11 is a partial perspective view of the conjunction of the neck and heel with the body, showing a slot in the heel that is provided to receive a heel plate (shown removed and displaced) at a position corresponding to that of the side of a conventional acoustic guitar where it abuts the neck.
Figure 12:
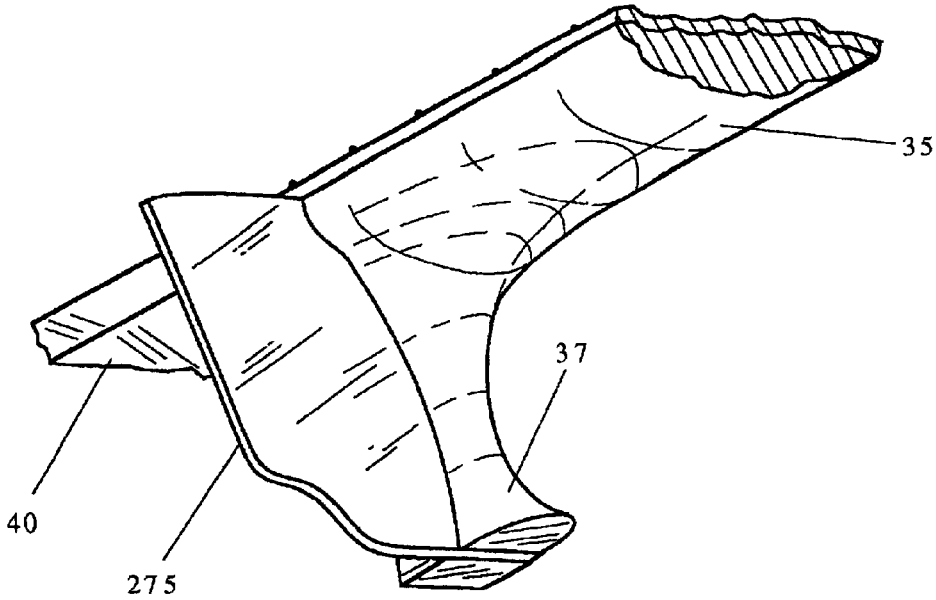
FIG. 12 shows the heel plate of FIG. 11 received in the heel slot.

FIGS. 11 and 12 illustrate the junction of the neck 35, body 40, and heel 37. The heel is provided with slot 270, which receives heel plate 275. The heel plate is secured to the heel by screws (not shown), which are inserted from the body side of the heel, passing through heel-plate holes 280. Thereby, as shown in FIG. 12, the heel plate is in a position and orientation corresponding to that of the side of a conventional acoustic guitar body, where the side abuts the neck. Thus, when the player moves his hand to a high position on the neck, the hand will contact what feels like a conventional guitar-body. Other guitar configurations, such as the "cutaway" style, would be modeled with heel plates of appropriate shape and location.

Figure 13:
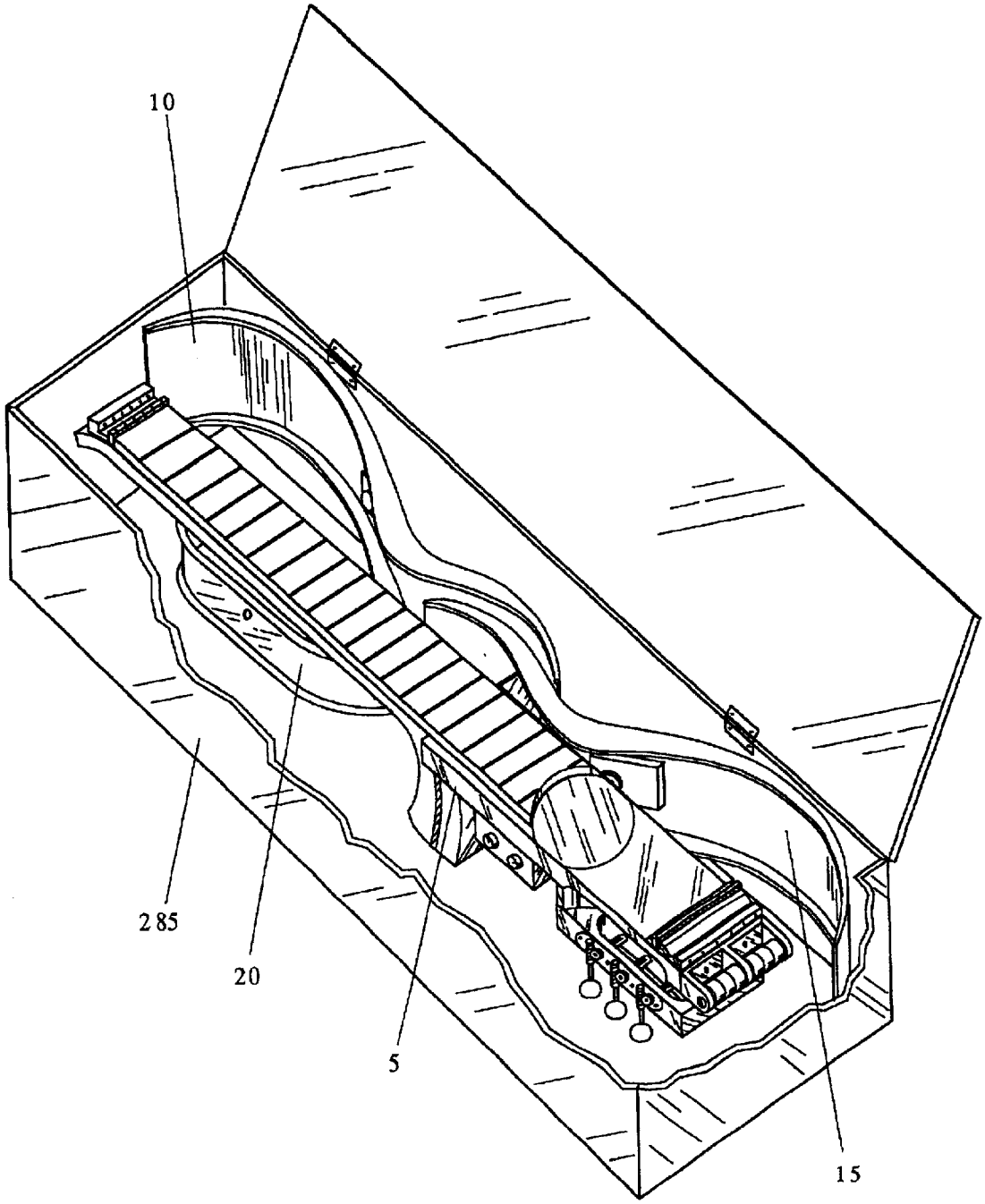
FIG. 13 is a perspective view of the disassembled guitar of FIG. 1, with its components arranged compactly in a container for convenient storage and transportation.

FIG. 13 illustrates one arrangement of the components of the disassembled guitar of FIG. 2, placed inside a container for storage or transport. First and second side panels 10 and 15 are placed along one of the long sides of container 285, their smaller curved segments nested. Side-panel support arm 20 is placed on the bottom of the case at one end, with its tips pointed toward the side panels. The central unit 5 is then placed in the case topside up, with support arm 20 substantially under the neck portion of said central unit. Other items, such as headphones, can also be stowed in various spaces still free. Protective separators may be provided to prevent the components from abrading each other. Container 285 may be a rigid or a soft case, preferable padded, with a handle and/or a shoulder strap. In FIG. 13, the container is shown oversize for, clarity.

Figure 14:
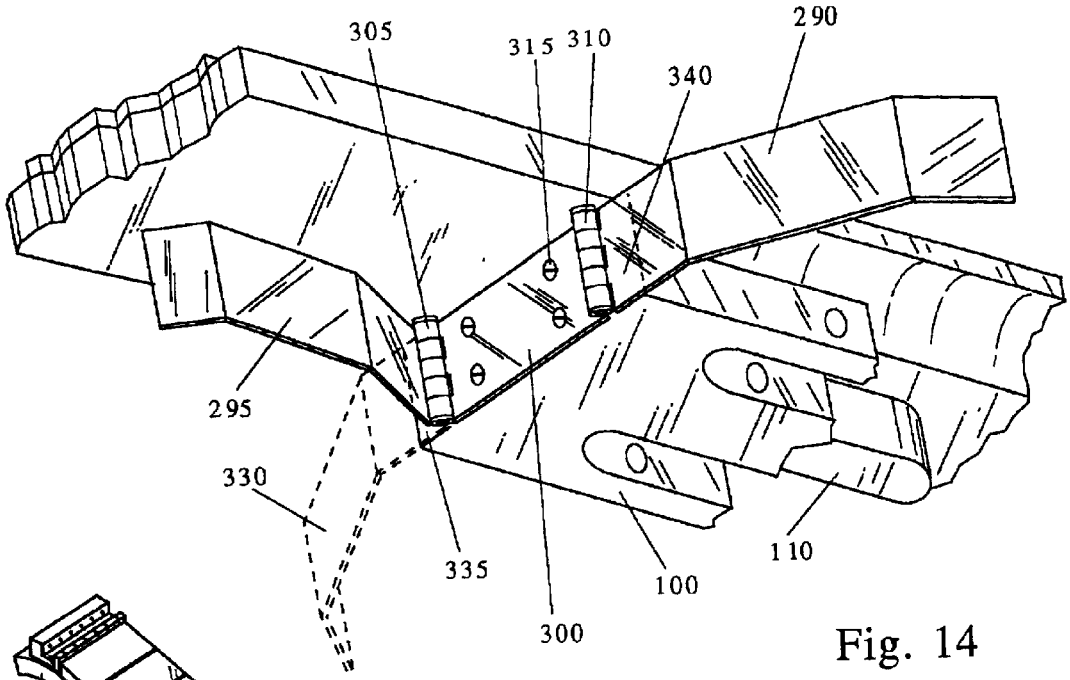
FIG. 14 shows one component of an alternative support-arm system for joining the central unit to the side panels, comprising a hinged assembly affixed to the spacer and tuning-machine block, with rigid leaves that, when deployed, engage receivers on the side panels and which, when disengaged from the receivers, fold back under the body section for compact storage.
Figure 15:
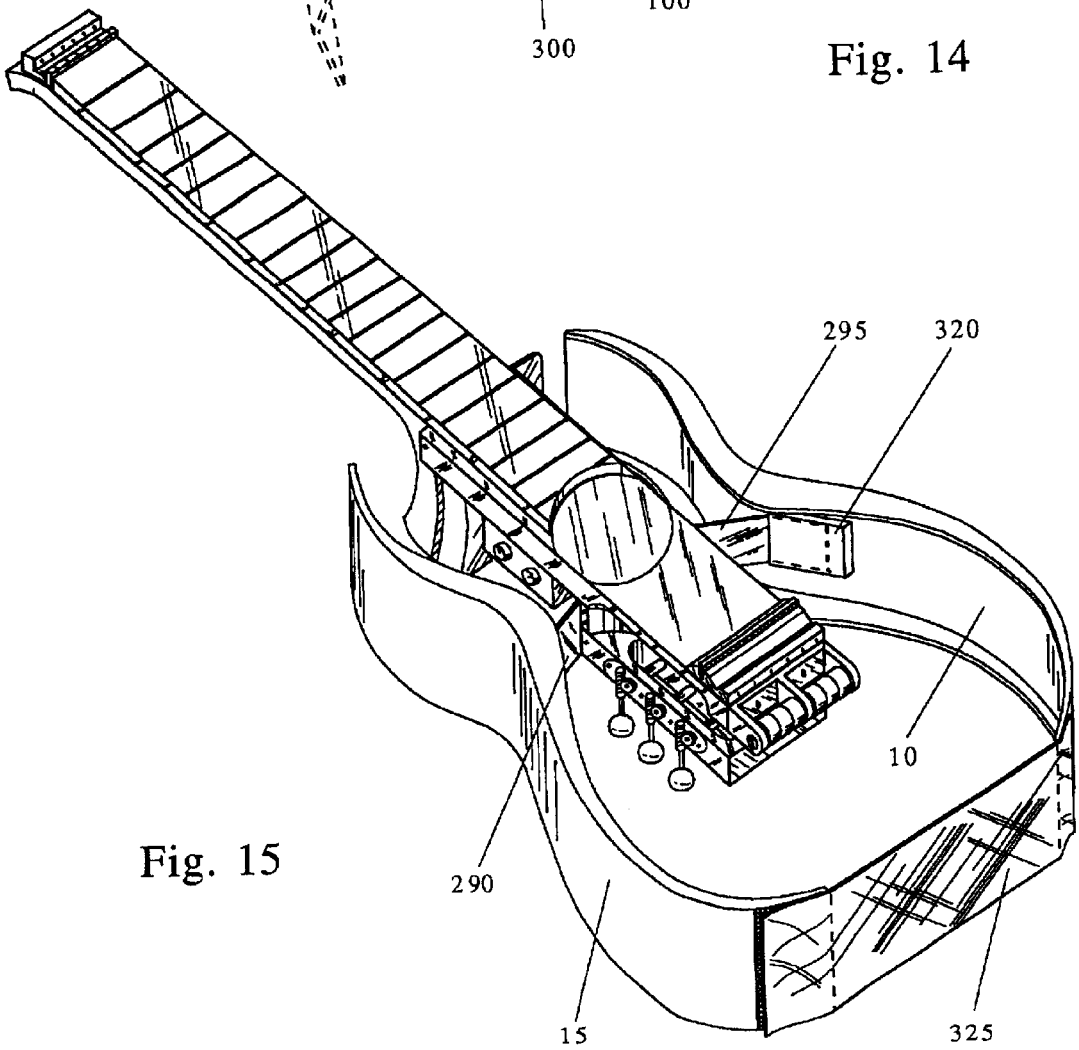
FIG. 15 is a perspective view of an assembled guitar utilizing the support-arm system of FIG. 14. The support-arm leaves are shown engaged with receivers on the side panels. A bottom closure system is illustrated comprising a fabric band and hook-and-loop fasteners to join the sides under tension.

FIGS. 14 and 15 illustrate an alternative embodiment of the present invention. First and second support arms 290 and 295 are pivotally coupled to a stationary member 300, respectively by hinges 305 and 310. Stationary member 300 is secured to the distal face of tuning-machine block 100 and spacer 110 by screws 315. Referring to FIG. 15, the support arm is coupled to the side panel by means of side panel receiver 320, which comprises a block affixed to the inner surface of the side panel, said block having on its inner surface a cavity shaped to receive the distal end of the pivoted support arm. A securing means, such as illustrated in FIG. 8, may be employed to releasably lock the side panel to receiver 320. Alternatively, as shown in FIG. 15, a bottom closure member 325 is employed both to complete the proximal perimeter of the instrument and to place the side panels and pivoting support arms under tension. In this illustration, closure member 325 is a fabric webbing, releasably secured to the side panels by hook-and-loop fastening material such as Velcro®. By pulling the side panels slightly toward each other while fastening the closure member, pivoting support arms 290 and 295 are pulled respectively against rotational stops 335 and 340, which comprise the ends of the distal face of tuning-machine block 100 and spacer 110. Additionally, sufficient tension can be attained by this means to cause the distal ends of the supports arms to be wedged in the side-panel receivers with sufficient friction to secure the side panels against inadvertent movement or release. Thereby, the entire structure becomes rigid and stable.

To disassemble the instrument to stow it in a manner similar to that illustrated in FIG. 13, first, the bottom closure member is released from at least one side panel, then the side panels are removed, and each support arm is rotated from its deployed position to its stowed position. In FIG. 14, support arm 295 is shown in the stowed position. Its deployed position is indicated by dashed element 330.

FIGS. 16 and 17 illustrate an alternative embodiment of the present invention wherein each side panel is pivotally coupled to the central unit by a multi-element side-panel support arm in a manner that permits the side panel to be retracted to a position adjacent the body, to make the assembly more compact for storage and travel. FIG. 16 illustrates the side panel in the retracted position and FIG. 17 illustrates it in the deployed position. The side-panel support arm comprises first link 345 affixed to central unit 5, second link 355 pivotally coupled to first link 345 by first hinge 350, and third link 365 pivotally coupled to second link 355 by second hinge 360 and, at its distal end, affixed to the inner surface of side panel 15. The manner of attachment of the support arm to the central unit and to the side panel is not indicated; however, the attachment method of FIG. 14 would suffice. Various known methods may be employed for locking the hinges in the storage and deployed positions. In the illustration of FIGS. 16 and 17, knobs 370 and 375 are indicated, which are parts of threaded hinge pins that can be tightened to prevent the hinge from rotating.

Because the stringed musical instrument of this invention does not have a resonating body, the sound volume that it radiates is quite low, enabling the player to practice without disturbing others. However, for effective practice electronic pickup and amplification combined with headphones is generally preferred. Electronic amplification is also required for coupling the instrument to an amplifier/loudspeaker system. Moreover, the absence of a resonating body deprives the instrument of the resonances that give conventional acoustic instruments their characteristic tonal quality. The present invention incorporates electronic means for amplifying the sound for headphone use, for driving an external amplifier/speaker to enable the instrument to be used for performances, for providing resonances which can be made to approximate a counterpart conventional instrument, and for the provision of other useful functions that are described below.

Figure 18:
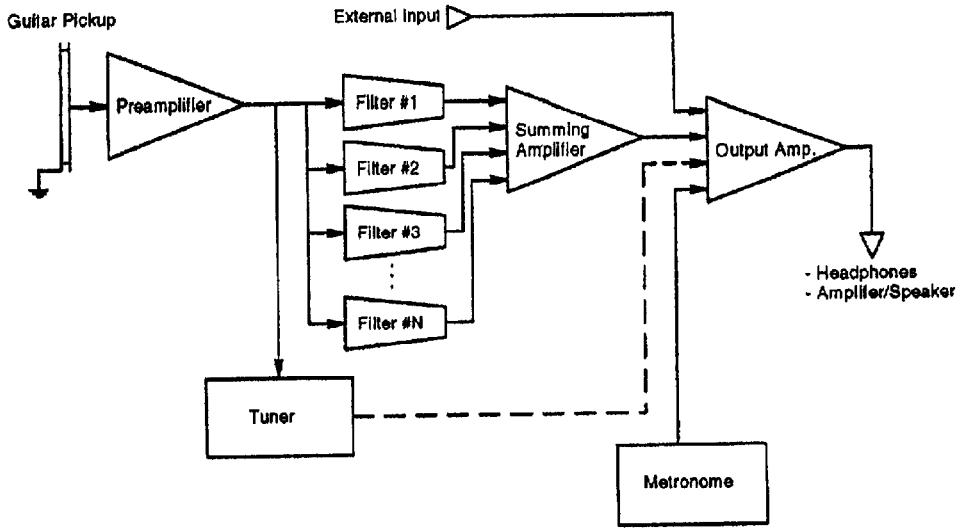
FIG. 18 is a general diagram of one analog embodiment of the electronic circuit of the instruments described herein.
Figure 19:
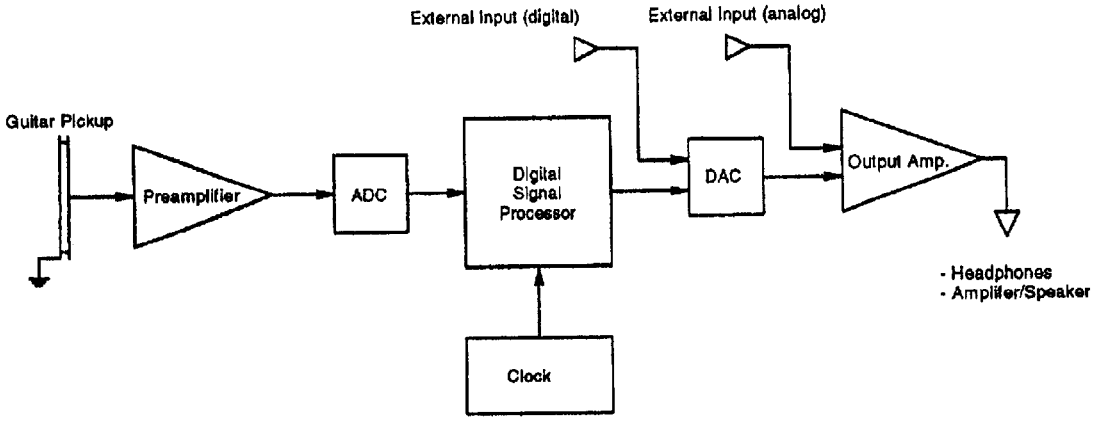
FIG. 19 is a general diagram of one digital embodiment of the electronic circuit of the instruments described herein.

FIGS. 18 and 19 illustrate respectively analog and combined analog/digital signal processors that comprise alternative embodiments of the present invention. Referring to FIG. 18, the electrical signals generated by the pickup are amplified by a preamplifier and operated upon by a plurality of filters, the outputs of which are combined by a summing amplifier. The characteristics of each filter (e.g., center frequency, bandwidth, gain, impulse response, and filter order) are selected to provide a desired overall multi-resonant characteristic. Other filter configurations are possible, including filters with nonlinear or time-varying characteristics, wherein tones of differing spectral content modulate each other. This invention is not limited to any particular method of electronic processing.

As illustrated in FIG. 18, additional electronic features are provided, which will be seen to be generally useful and to be particularly useful in a portable instrument, especially for practicing. An electronic tuning aid is included. Electronic circuitry for tuning aids is well known; such devices are produced by many manufacturers. Most operate on one of two principles: They either (1) generate tones audible to the player, who then adjusts the tension of each string until it sounds the same as the corresponding reference tone, or (2) employ a frequency-measurement circuit that detects the primary frequency of the plucked string and indicates, usually on a visual display, whether the string is tuned high, low, or on key. One embodiment of the present invention is the combination of a stringed musical instrument and a tuning aid. In another embodiment of the present invention, a stringed musical instrument is combined with an electronic metronome, the sounds of which may be transmitted directly to the player by way of the headphones that present the amplified and filtered signals from the pickup. Electronic circuits for metronomes also are well know. The present invention also provides for the input of electronic signals from other electronic audio sources, e.g., a tape or digital recorder, and for the combining of such sounds with those from the pickup.

It is well known that if electronic signals are appropriately conditioned for each ear and presented stereophonically, the sound will be experienced by the listener as emanating from a specific direction and range in space (see, e.g., Brown, C. P. and R. O. Duda, "A Structural Model for Binaural Sound Synthesis", IEEE Trans. Speech and Audio Proc. 6, 476–488, 1998.) In another embodiment of the present invention, signal-conditioning circuits are employed that present to each ear a differently modified version of the amplified electronic signal from the pickup. The circuits simulate the differences in time delay and in the frequency-dependent signal amplitude that would have been imposed on acoustic waves travelling from the instrument to each ear. The latter are caused by variations in head shadowing and by multi-path reverberation in the pinna of the listener's ear. Thereby, the sounds may appear to the player to be emerging directly from the instrument in his hands rather than originating within his head, which is the experience one has when wearing headphones.

FIG. 19 illustrates a combined analog and digital implementation of the electronics portion of the present invention. As in the FIG.-18 embodiment, the pickup signals are first pre-amplified. These signals are then digitized by an analog-to-digital converter and the signal processing operations described with reference to FIG. 18 are then carried out in a digital signal processor, using digital filter techniques well known in the art. The processed signals are converted to analog form by a digital-to-analog converter and amplified in an output stage. The tuner and metronome functions are generated within the digital signal processor.

Although the present invention has been shown and described with respect to preferred embodiments, various changes and modifications, which are obvious to a person skilled in the art to which the invention pertains, are deemed to be within the spirit and scope of the invention.

I claim:

1. A musical instrument comprising:

an elongated unitary neck and body adapted for stringed play, wherein an adaptation for stringed play includes a string tensioning system rigidly coupled to the underside of the unitary neck and body;

at least one support arm coupled to the unitary neck and body and extending to at least one side thereof; and at least one side panel coupled to the support arm.

2. The musical instrument according to claim 1 wherein the string tensioning system is spaced apart from the unitary neck and body.

3. The musical instrument according to claim 1 wherein a string-path reverser is disposed at the proximal end of the body to guide the strings over the end of the body and to the string tensioning system.

4. The musical instrument according to claim 3 wherein the string-path reverser comprises a plurality of pulleys or rollers on a common axle and secured within a frame.

5. The musical instrument according to claim 1 wherein the support arm is coupled to the unitary neck and body by a releasable attachment to a distal end of the string tensioning system.

6. A musical instrument, comprising:

an elongated unitary neck and body adapted for stringed play;

a support arm releasably coupled to the unitary neck and body and extending to a first side and a second side thereof;

a first side panel releasably coupled to a first end of the support arm; and a second side panel releasably coupled to a second end of the support arm.

7. The musical instrument according to claim 6, wherein said instrument is a guitar.

8. The guitar according to claim 7 wherein a heel is provided at a junction of the unitary neck and body.

9. The guitar according to claim 8 wherein a heel plate corresponding to a like segment of a side of a resonating body of an acoustic guitar of conventional design is affixed to the heel or is received within a slot provided within the heel.

10. The musical instrument according to claim 6, wherein adaptation for stringed play is provided by the addition of:

a string tie block for securing strings near a distal end of the unitary neck and body;

a nut, disposed proximal to the tie block, for determining the distal end of the active portions of the strings;

a slotted bridge, affixed to a top of a proximal end of the unitary neck and body;

a saddle received within a bridge slot of the slotted bridge; and an acousto-electric transducer for conversion of string vibrations to electrical waves suitable for electronic amplification and sound reproduction.

11. The musical instrument according to claim 10 wherein the acoustic-to-electric transducer is a piezoelectric pickup received within the bridge slot under the saddle.

12. The musical instrument according to claim 11 further including a strip of compliant material disposed between the saddle and the pickup or between the pickup and the bottom of the bridge slot.

13. The musical instrument according to claim 10 wherein the slotted bridge further includes a string guide proximal to the bridge slot to constrain the strings to spaced apart paths.

14. A musical instrument, comprising:

an elongated unitary neck and body adapted for stringed play;

at least one support arm releasably couple to the unitary neck and body and extending to at least one side thereof; and at least one side panel releasably coupled to the support arm.

15. The musical instrument according to claim 14, wherein a coupler by which the support arm is releasably coupled to the side panel comprises:

a block affixed to an inner surface of the side panel, said block provided with a captive nut accessible at its surface and a thumbscrew partially engaged with said nut; and a keyhole-shaped aperture in the support arm wherein one end of the keyhole is adapted to received a head of the thumbscrew and the other to receive a threaded shank of the thumbscrew.

16. A musical instrument comprising:

an elongated unitary neck and body adapted for stringed play;

at least one support arm coupled to the unitary neck and body and extending to at least one side thereof; and at least one side panel coupled to the at least one support arm, wherein:

a first support arm is pivotally coupled to and disposed on a first side of the unitary neck and body and is releasably coupled to a first side panel; and a second support arm is pivotally coupled to and disposed on a second side of the unitary neck and body and is releasably coupled to a second side panel.

17. The musical instrument according to claim 16 further including:

rotational stops to establish a deployed position of each support arm; and a tensioning bottom-closure device which, when connected between bottom sections of the first and second side panels, applies a force between the first and second side panels that is reflected to the pivoting support arms, holding the pivoting support arms against their respective rotational stops.

18. A musical instrument according to claim 16, wherein the support arm is pivotally coupled at a first end to the unitary neck and body and pivotally coupled at a second end to a side panel, so as to permit the side panel to be deployed for use or drawn close to the unitary neck and body for storage.

19. A musical instrument comprising:

an elongated unitary neck and body adapted for stringed play;

at least one support arm coupled to the unitary neck and body and extending to at least one side thereof;

at least one side panel coupled to the support arm;

an acousto-electric transducer for converting mechanical energy from vibrating strings of the musical instrument into electrical signals; and at least one electronic signal processing circuit for processing the electrical signals to produce for a listener the sensation that sounds produced by the vibrating strings are arriving from a location of the musical instrument.

20. The musical instrument of claim 19, wherein at least one electronic signal processing circuit processes the electrical signals for presentation on headphones having a left speaker and a right speaker by imposing a first filtering to electrical signals delivered to the left speaker and imposing a second filtering to electrical signals delivered to the right speaker.

21. A musical instrument comprising:

an elongated unitary neck and body adapted for stringed play;

at least one support arm coupled to the unitary neck and body and extending to at least one side thereof;

at least one side panel coupled to the support arm; and a device that simulates visually a sound hole.

22. The musical instrument of claim 21, wherein graphic or textual material is applied to the device that simulates visually the sound hole.

23. A musical instrument, comprising:

an elongated unitary neck and body adapted for stringed play;

a support arm coupled to the unitary neck and body and extending to a first side and a second side thereof;

a first side panel coupled to a first end of the support arm; and a second side panel coupled to a second end of the support arm.

24. The musical instrument according to claim 23, wherein the first and second side panels correspond to segments of opposing sides of a resonating body of an acoustic instrument of conventional design.

25. The musical instrument according to claim 24, wherein the first side panel comprises an edge corresponding to a contiguous portion of a top face of the resonating body of said conventionally designed instrument.

26. The musical instrument according to claim 24, wherein the second side panel comprises an edge corresponding to a contiguous portion of a bottom face of the resonating body of said conventionally designed instrument.

27. The musical instrument according to claim 24, wherein a bottom brace is releasably coupled between bottoms of opposing side panels.

28. The musical instrument of claim 23, further comprising an acousto-electric transducer and electronic signal processing circuits for amplification of signals and for alteration of their temporal and spectral characteristics in a manner that approximates the effect of a resonant body.

29. The musical instrument according to claim 28 wherein the electronic signal processing circuits include a plurality of filters the outputs of which are summed.

30. The musical instrument according to claim 29 wherein at least one of the filters is a band-pass filter.

31. The musical instrument of claim 23, further comprising compliant material for dampening string vibrations, thereby shortening ring-down time.

* * * * *